US008794911B2

(12) United States Patent
Murphy et al.

(10) Patent No.: US 8,794,911 B2
(45) Date of Patent: Aug. 5, 2014

(54) ANTI-ROTATION SLOT FOR TURBINE VANE

(75) Inventors: Richard M. Murphy, East Hampton, CT (US); Matthew S. Gleiner, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 1130 days.

(21) Appl. No.: 12/749,971

(22) Filed: Mar. 30, 2010

(65) Prior Publication Data

US 2011/0243722 A1 Oct. 6, 2011

(51) Int. Cl.
*F01D 9/02* (2006.01)

(52) U.S. Cl.
USPC ..... 415/191; 415/209.2; 415/209.3; 415/211.2

(58) Field of Classification Search
USPC ..... 415/191, 209.2, 209.3; 29/889.21, 29/889.22
See application file for complete search history.

(56) References Cited

U.S. PATENT DOCUMENTS

| | | | | |
|---|---|---|---|---|
| 3,362,681 | A * | 1/1968 | Smuland | 415/115 |
| 3,628,880 | A * | 12/1971 | Smuland et al. | 415/175 |
| 4,017,213 | A * | 4/1977 | Przirembel | 416/97 A |
| 4,566,851 | A | 1/1986 | Comeau et al. | |
| 4,749,333 | A | 6/1988 | Bonner et al. | |
| 4,856,963 | A | 8/1989 | Klapproth et al. | |
| 5,004,402 | A | 4/1991 | Burchette et al. | |
| 5,141,394 | A * | 8/1992 | Donlan | 415/190 |
| 5,176,496 | A | 1/1993 | Correia et al. | |
| 5,211,536 | A | 5/1993 | Ackerman et al. | |
| 5,343,694 | A | 9/1994 | Toborg et al. | |
| 5,709,530 | A | 1/1998 | Cahill et al. | |
| 7,144,218 | B2 | 12/2006 | Dube et al. | |
| 8,360,716 | B2 * | 1/2013 | Bergman et al. | 415/190 |
| 2005/0281694 | A1 | 12/2005 | Rogers | |

* cited by examiner

*Primary Examiner* — Ninh H Nguyen
(74) *Attorney, Agent, or Firm* — Carlson, Gaskey & Olds, P.C.

(57) ABSTRACT

A fixed vane section for a gas turbine engine includes an anti-rotation slot that receives a pin for maintaining a desired position while providing for movement encountered during operation. The example anti-rotation slot includes a compound radius on inner surfaces to reduce stresses encountered during operation.

16 Claims, 4 Drawing Sheets

ANTI-ROTATION SLOT FOR TURBINE VANE

BACKGROUND

This disclosure generally relates to an interface for holding a position of a vane. More particularly, this disclosure relates to an interface surface of a position retention slot for a turbine vane.

A gas turbine engine includes turbine vanes that are stationary and direct a flow of gases against airfoils of rotating turbine blades. The position of the turbine vanes may be maintained by including locating features on the support that is received within a portion of the turbine vane. The locating feature may be a post that extends axially from the support. The turbine vane may include a slot into which the post is received. The post and slot arrangement allow radial thermal expansion while also preventing rotation about the support. During periodic inspections, the slot is checked for signs of wear and distress. Distress can cause deterioration of the part in areas where stresses are concentrated. Accordingly, it is desirable to design and develop parts that are configured to reduce stress loads.

SUMMARY

A fixed vane section for a gas turbine engine includes an anti-rotation slot that receives a pin for maintaining a desired position while providing for movement due to thermal growth encountered during operation. The example anti-rotation slot includes is spaced a distance away from any air seal and includes a compound radii on inner surfaces to reduce stresses encountered during operation.

These and other features disclosed herein can be best understood from the following specification and drawings, the following of which is a brief description.

DETAILED DESCRIPTION

Figure 1:
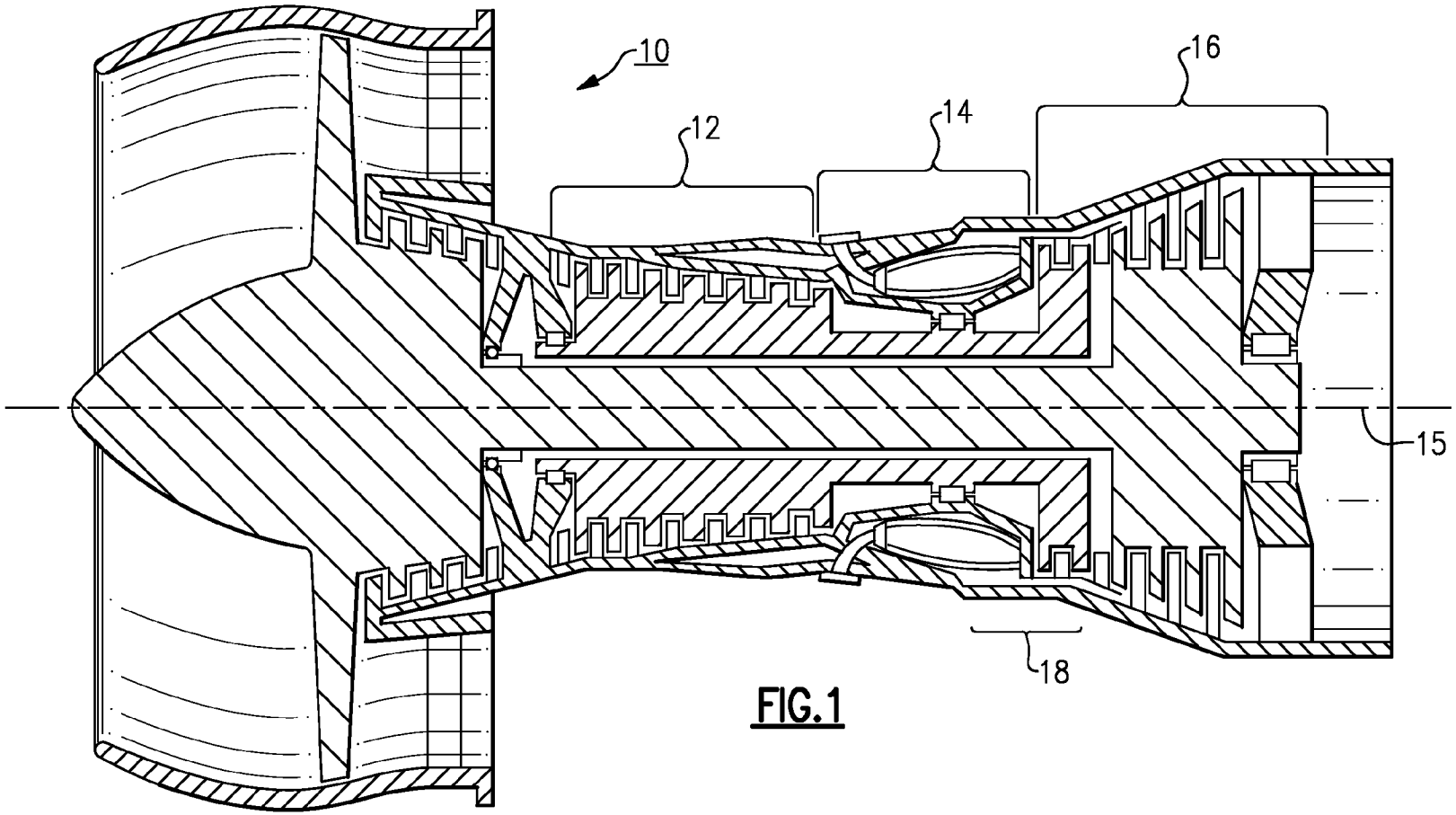
FIG. 1 is a schematic view of a gas turbine engine.

Referring to FIG. 1, an example gas turbine engine is schematically shown and indicated at 10. The gas turbine engine 10 includes a compressor section 12 where intake air is compressed and fed into a combustor section 14. In the combustor section 14 the compressed air is mixed with fuel and ignited to generate a high energy and high velocity stream of gases. The stream of gases flows through a turbine section 16 where energy from the stream of gases is utilized to drive the compressor section 12. Gases generated by the combustor 14 are guided through fixed vanes within sections 16 and 18 that direct the gas flow to interface with airfoils of successive rows or stages of rotating turbine blades of the turbine section at a desired orientation.

Figure 2:
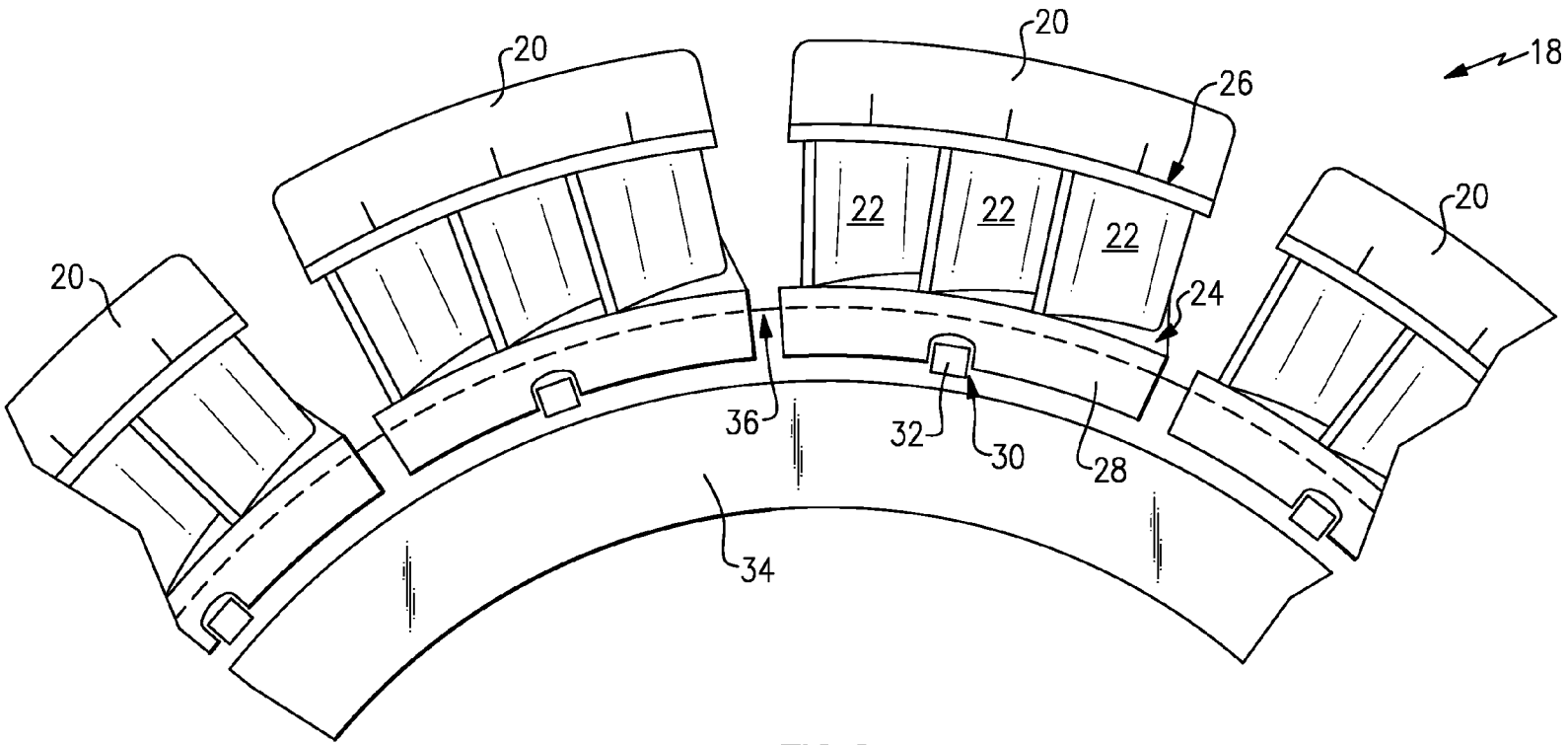
FIG. 2 is a schematic view of an example several example turbine vanes.

Referring to FIG. 2, sections 16 and 18 of the example gas turbine engine include turbine vanes 20 disposed circumferentially along a rail on the outer periphery of the support 34.

The vanes 20 are prevented from rotating or moving about the axis 15 an inner air seal 36 disposed on the support. Each of the turbine vanes 20 includes one or more airfoils 22 that direct the gas flow through the turbine segments 16 and 18. The support 34 includes the air seal 36 that cooperates with a flange 28 of each turbine vane 20 to prevent gas stream flow between or around the turbine vanes 20.

The turbine vanes 20 are butted against each other and prevented from rotating on the support by an anti-rotation post 32 received in a slot 30. The turbine vanes 20 include an inboard segment or platform 24 and an outboard segment or platform 26 that is spaced radially outboard of the inboard segment 24. At least one airfoil 22 extends from the inboard segment 24 and the outboard segment 26. In the disclosed example there are three airfoils 22, however, the number of airfoils 22 in each turbine vane 20 could be more or less depending on the desired application and environment.

The flange 28 extends radially inward from the inboard segment 24 and includes the slot 30. The example slot 30 is disposed midway between opposing ends of the flange 28. The slot 30 could also be disposed in other locations as is required to maintain a desired position of the turbine vane 20. The post 32 is received within the slot 30 and holds the turbine vane 20 in a desired circumferential position. The slot 30 includes an open end that provides for radial movement of the turbine vane 20 to accommodate thermal cycling during operation.

Figure 4:
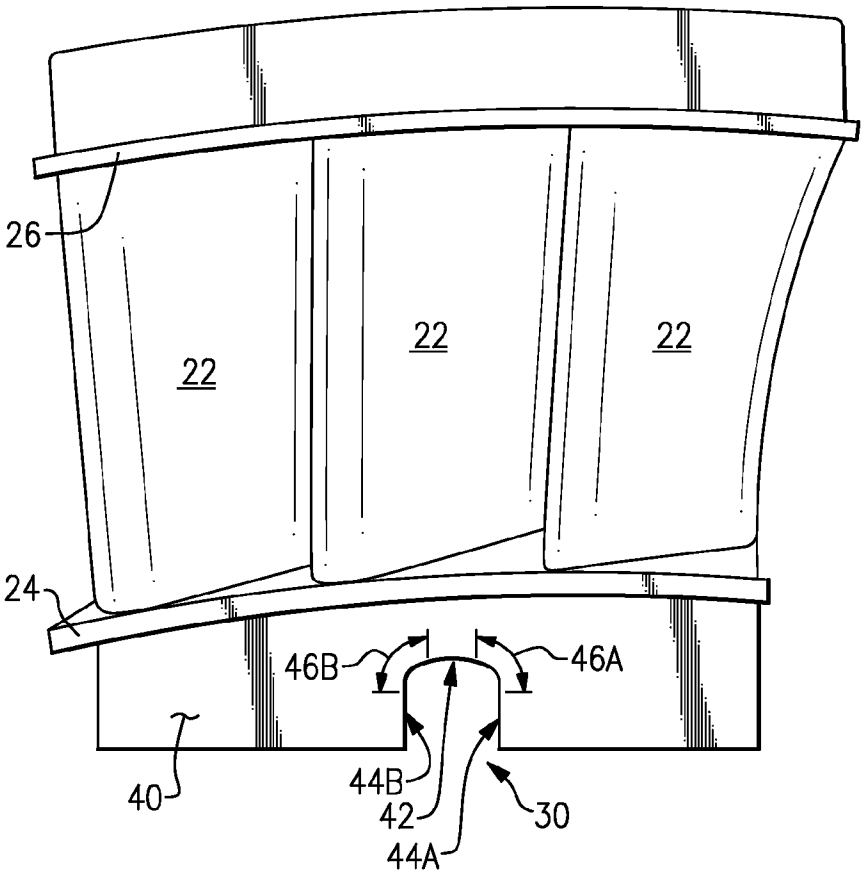
FIG. 4 is a front view of the example turbine vane.
Figure 3:
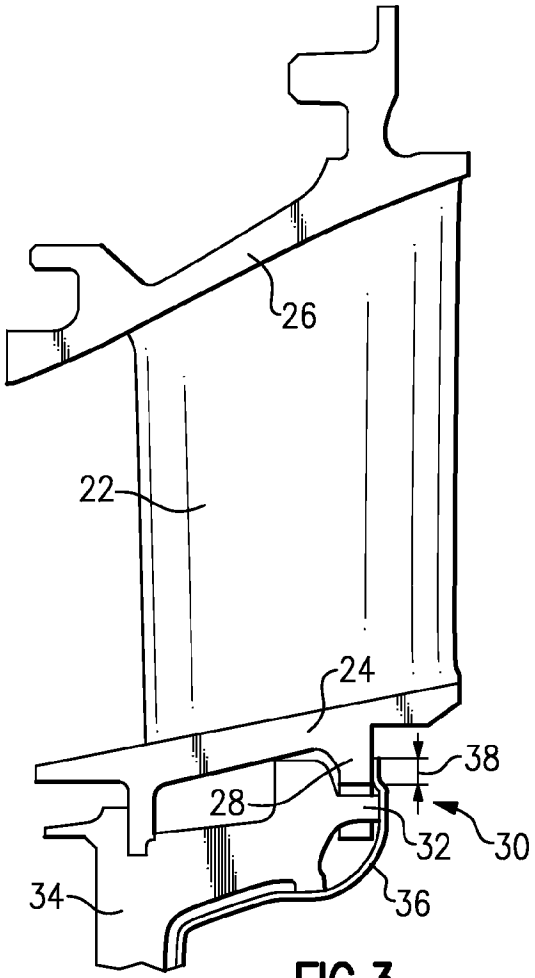
FIG. 3 is a partial sectional view of the example turbine vane.

Referring to FIGS. 3 and 4, the slot 30 is open through the flange 28. Adjacent to the flange 28 is the stationary air seal 36 that interacts with the flange 28 to prevent the leakage flow of cooling air that passes through airfoils 22. This cooling air in turn cools the airfoil 22 to operate is temperatures near its melting point. The slot 30 extends radially upward into the flange 28 and terminates at a back surface 42. The slot 30 includes the back surface 42 and two side surfaces 44A, 44B. The back surface 42 includes a compound radius and the two side surfaces 44A and 44B transition smoothly into the back surface through a corresponding transition region 46A, 46B. The back surface 42 is spaced apart a distance 38 from an end of the air seal 36 such that the slot 30 is not exposed to gas flow to create an alternate leak path in response to thermal growth encountered during engine operation. The slot 30 in the flange 28 can be utilized in turbine vanes which allow cooling air to pass through the airfoil, and may also be utilized in turbine vanes that do not provide cooling airfoil through the airfoil. Accordingly, the disclosed slot 30 will benefit both cooled and non-cooled turbine vanes by substantially eliminating stresses encountered during operation.

Figure 5:
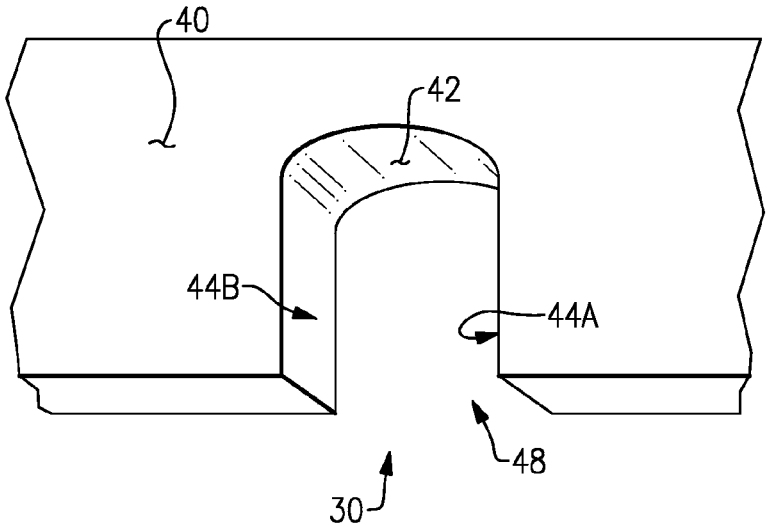
FIG. 5 is a perspective view of an example anti-rotation slot.
Figure 6:
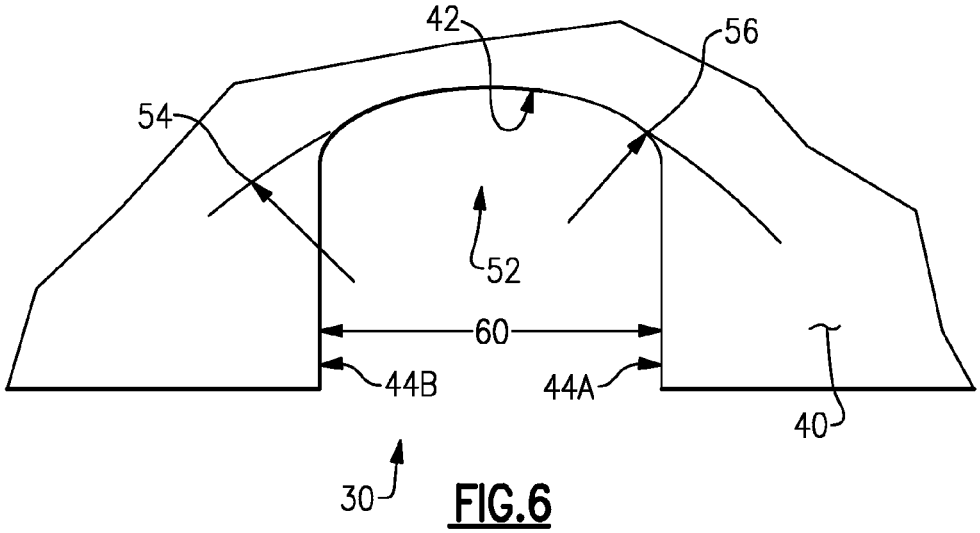
FIG. 6 is an enlarged front view of the example anti-rotation slot.

Referring to FIGS. 5 and 6, the smooth transition of the back surface 42, through the transition regions 46A, 46B is formed as a compound radius 52. The example compound radius 52 includes a first radius 54 along the back surface 42 and a second radius 56 that is smaller than the first radius 54 through the transition region 46A, 46B between the back surface 42 and the side surfaces 44A, 44B. In the example, the first radius 52 is approximately four times larger than the second smaller radius 56. Accordingly, a ratio of the first radius 52 relative to the second radius is approximately four. The back surface 42 and the two side surfaces 44A, 44B are transverse the front surface 40 and back surface 50. The slot 30 extends entirely through the flange 28 to provide the opening for the post 32.

The slot 30 includes a width 60 that corresponds to the post 32. The larger radius 54 is therefore utilized together with the second radius 56 to provide a substantially curved interior profile. Sharp radius corners within the slot 30 can result in a concentration of stresses that could reduce part durability, while one large radius makes it difficult to fit within desired size limitations and maintain sufficient sealing performance during engine operation. The example compound radius 52 provided by the first and second radii 54, and 56 reduces the stresses placed in the turbine vane 20 without degrading sealing performance. The example compound radius 52 eliminates sharp corners in the slot 30 and reduces mechanical stresses on the flange that improve part performance and durability.

According the application of the compound radii on the back surface 42 and the side surfaces 44A, 44B reduces or substantially eliminates the stresses encountered during operation and accompanying thermal cycling. The reduction in stresses provides for the extended operational life of the turbine vane 20.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbine vane comprising:

a platform segment;

an airfoil segment extending from the platform segment; and a flange portion extending from the platform segment, the flange portion including a slot with a compound radius over at least a portion of a surface that engages an alignment post.

2. The turbine vane as recited in claim 1, wherein the slot is defined by a back surface and two side surfaces, wherein the back surface comprises a first radius, and a transition region between the back surface and the two side surfaces, the transition region comprising a second radius that is smaller than the first radius.

3. The turbine vane as recited in claim 2, wherein the slot is further defined by a forward surface, with the back surface and the two side surfaces disposed transverse relative to the forward surface.

4. The turbine vane as recited in claim 2, wherein the back surface of the slot is spaced radially from a top surface of the platform.

5. The turbine vane as recited in claim 1, wherein the airfoil segment comprises at least two airfoils extending from the platform segment.

6. The turbine vane as recited in claim 5, including an upper platform segment attached to the at least two airfoils.

7. The turbine vane as recited in claim 1, wherein the slot comprises one slot disposed at an intermediate position between ends of the flange portion.

8. The turbine vane as recited in claim 1, wherein the platform includes at least the front flange and a rear flange spaced axially apart from the front flange.

9. A turbine vane comprising:

an inboard segment and an outboard segment that is spaced radially apart from the inboard segment;

at least one airfoil extending radially between the inboard and outboard segments; and an inner flange including a portion that includes an alignment slot, wherein the alignment slot comprises a back surface that includes a compound radius.

10. The turbine vane as recited in claim 9, wherein the slot compound radius comprises a first radius and at least one second radius smaller than the first radius.

11. The turbine vane as recited in claim 10, wherein the slot includes first and second sides and a transition region between the back surface and the side surfaces with the second radius disposed in the transition region.

12. The turbine vane as recited in claim 9, wherein the back surface is spaced a distance radially inward from the inboard segment.

13. The turbine vane as recited in claim 9, wherein the slot comprises an open end opposite the back surface.

14. A method of forming a turbine vane including the steps of:

forming an inboard segment and an outboard segment that is spaced radially apart from the inboard segment;

forming an airfoil extending radially between the inboard and outboard segments; and forming a compound radius on a back surface of a slot within an inner flange extending from the inboard segment.

15. The method as recited in claim 14, including forming the slot with an open end opposite the back surface and a transition surface between the back surface and two side surfaces.

16. The method as recited in claim 15, including the step of forming the compound radius with a first radius of the back surface and second radius at the transition portions between the back surface and each of the two side surfaces.

* * * * *